US011585228B2

(12) United States Patent
Galoul et al.

(10) Patent No.: US 11,585,228 B2
(45) Date of Patent: Feb. 21, 2023

(54) TECHNIQUE FOR COOLING INNER SHROUD OF A GAS TURBINE VANE

(71) Applicant: DOOSAN ENERBILITY CO., LTD, Changwon-si (KR)

(72) Inventors: Vincent Galoul, Baden (CH); Simon Hauswirth, Baden (CH); Richard Jones, Baden (CH)

(73) Assignee: DOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/516,752

(22) Filed: Nov. 2, 2021

(65) Prior Publication Data

US 2022/0154589 A1 May 19, 2022

(30) Foreign Application Priority Data

Nov. 13, 2020 (EP) ..... 20207344

(51) Int. Cl.
*F01D 9/06* (2006.01)

(52) U.S. Cl.
CPC ..... *F01D 9/065* (2013.01); *F05D 2220/32* (2013.01); *F05D 2240/12* (2013.01); *F05D 2240/81* (2013.01); *F05D 2260/201* (2013.01)

(58) Field of Classification Search
CPC ..... F01D 11/005; F01D 9/041; F01D 9/065; F05D 2220/30; F05D 2220/32;
(Continued)

(56) References Cited

U.S. PATENT DOCUMENTS 4,526,226 A * 7/1985 Hsia ..... F01P 1/00 165/170
4,573,865 A * 3/1986 Hsia ..... F01P 1/00 415/173.1

(Continued)

FOREIGN PATENT DOCUMENTS

EP 2626519 A1 2/2012
EP 3273002 A1 7/2016

OTHER PUBLICATIONS

European Patent Office Search Report dated Apr. 21, 2021.

*Primary Examiner* — Jesse S Bogue
(74) *Attorney, Agent, or Firm* — Harvest IP Law LLP

(57) ABSTRACT

A turbine vane is provided. The turbine vane may include an inner shroud having an upper surface and a lower surface, a seal unit disposed in the lower surface of the inner shroud and defining a first region and a second region in the lower surface of the inner shroud, a first impingement unit arranged in the first region and comprising a first impingement plate facing the inner shroud defining a first impingement chamber therebetween, wherein the first impingement plate is configured to receive cooling air and form impingement jet directed to the first impingement chamber, a second impingement unit arranged in the second region and comprising a second impingement plate facing the inner shroud defining a second impingement chamber therebetween, and at least one connector flow channel configured to direct cooling air from the first impingement chamber to the second region, wherein the second impingement plate is configured to receive cooling air from the at least one connector flow channel and form impingement jet directed to the second impingement chamber.

20 Claims, 10 Drawing Sheets

(58) Field of Classification Search
CPC ..... F05D 2240/12; F05D 2240/81; F05D 2260/201; F05D 2260/202; Y02T 50/60
See application file for complete search history.

(56) References Cited

U.S. PATENT DOCUMENTS

| | | | | |
|---|---|---|---|---|
| 5,098,257 | A * | 3/1992 | Hultgren | F01D 5/18 415/116 |
| 6,120,249 | A * | 9/2000 | Hultgren | F01D 5/187 416/193 A |
| 7,097,418 | B2 * | 8/2006 | Trindade | F01D 5/18 415/115 |
| 8,353,663 | B2 * | 1/2013 | Arzel | F01D 5/08 415/115 |
| 8,814,507 | B1 * | 8/2014 | Campbell | F01D 11/24 415/173.1 |
| 9,683,444 | B1 * | 6/2017 | Jones | F01D 5/188 |
| 10,989,068 | B2 * | 4/2021 | Packer | F01D 25/12 |
| 2003/0131980 | A1 * | 7/2003 | DeMarche | F01D 11/24 165/169 |
| 2005/0281663 | A1 * | 12/2005 | Trindade | F01D 5/18 415/1 |
| 2008/0131262 | A1 * | 6/2008 | Lee | F23R 3/06 415/176 |
| 2008/0131263 | A1 * | 6/2008 | Lee | F01D 11/10 415/176 |
| 2012/0121415 | A1 | 5/2012 | Brittingham | |
| 2015/0275763 | A1 * | 10/2015 | Kanjiyani | F01D 25/12 415/179 |
| 2016/0201472 | A1 * | 7/2016 | Okajima | F01D 9/04 29/889.7 |
| 2018/0100409 | A1 * | 4/2018 | Cochet | F01D 11/24 |

* cited by examiner

TECHNIQUE FOR COOLING INNER SHROUD OF A GAS TURBINE VANE

CROSS-REFERENCE TO RELATED APPLICATION

This application claims priority to European Patent Application No. 20 207 344.1, filed on Nov. 13, 2020, the disclosure of which is incorporated herein by reference in its entirety.

FIELD

Apparatuses and methods consistent with exemplary embodiments relate to cooling of gas turbines, and more particularly, to techniques for cooling inner shrouds of gas turbine vanes.

BACKGROUND

A gas turbine is a power engine that mixes air compressed by a compressor with fuel for combustion and rotates a turbine with high-temperature gas produced by the combustion. The gas turbine is used to drive a generator, an aircraft, a ship, a train, and so forth.

A gas turbine vane, also referred to as a nozzle, includes an airfoil extending radially between an inner shroud and an outer shroud, also referred to as inner platform and outer platform. The inner shroud and the outer shroud define parts of hot gas flow path through the turbine section and are immersed in hot gas during turbine operation. Thus, cooling of the shrouds is necessary.

FIG. 2 schematically illustrates a related art cooling scheme for an inner shroud 100 of a turbine vane 44. The turbine vane 44 is positioned downstream of a transition duct 17 extending from a combustor of the gas turbine in an annular hot gas path 55 defined in part by the inner shroud 100 and an outer shroud 90 of the turbine vane 44. An airfoil 60 of the turbine vane 44 extending between the outer and inner shrouds 90, 100 is disposed in the hot gas path 55. The outer shroud 90 is disposed towards an outer casing of a stator 42 and defines a radially outer surface 52 of the hot gas path 55, while the inner shroud 100 is disposed radially inward towards a central axis, i.e., a rotational axis of the gas turbine, and defines a radially inner surface 54 of the hot gas path 55.

Hot gas, also referred to as combustion product 34, flows from the combustor into the hot gas path 55 via the transition duct 17, and the airfoil 60 and surfaces of the outer and inner shrouds 90, 100, e.g., an upper surface 100*a* of the inner shroud 100, are immersed in hot gas34. Cooling air 5 is supplied from the compressor into the turbine vane 44 to cool the turbine vane 44.

Referring to FIG. 2, a portion 5*a* of cooling air 5 is delivered through a first flow channel 9*a* to the inner shroud 100, e.g., a lower surface 100*b* of the inner shroud 100. A seal unit 70, also referred to as axial seal 70, is disposed at the lower surface 100*b* of the inner shroud 100 to maintain an appropriate pressure of the cooling air 5 in a first region R1 located axially upstream of a second region R2 at the lower surface 100*b* of the inner shroud 100. The seal unit 70 may be formed as an annular plate extending around the central axis of the gas turbine and sealing the flow of cooling air 5*a* towards the second region R2. The seal unit 70 is referred to as axial seal since it is configured to block flow of cooling air 5 in the axial direction. The seal unit 70 is required to maintain appropriate pressure in the first region R1 so that adequate cooling air flow may be maintained to different parts of the turbine vane 44.

In addition, a portion 5*b* of cooling air 5 is transmitted through a second flow channel 9*b* to a turbine blade 38 located downstream of the turbine vane 44 via a cooling air channel 36*c* formed through a blade carrying disk 36. An interstage seal 80, also referred to as a radial seal such as a labyrinth seal 80, is disposed between the turbine vane 44 and the blade carrying disk 36, and is configured to block flow of cooling air 5 in a radial direction between a vane stage comprising the turbine vane 44 and a blade stage comprising the turbine blade 38 and the blade carrying disk 36.

However, a part of the inner shroud 100 in the second region R2 is not appropriately cooled. Therefore, there is a need to provide a mechanism or technique for effectively cooling the inner shroud of the gas turbine vane.

SUMMARY

Aspects of one or more exemplary embodiments provide a technique for effectively cooling the inner shroud of the gas turbine to improve cooling without increasing an amount of cooling air from the compressor.

Additional aspects will be set forth in part in the description which follows and, in part, will become apparent from the description, or may be learned by practice of the exemplary embodiments.

According to an aspect of an exemplary embodiment, there is provided a turbine vane including: an inner shroud having an upper surface and a lower surface, a seal unit disposed in the lower surface of the inner shroud and defining a first region and a second region in the lower surface of the inner shroud, a first impingement unit arranged in the first region and comprising a first impingement plate facing the inner shroud defining a first impingement chamber therebetween, wherein the first impingement plate is configured to receive cooling air and form impingement jet directed to the first impingement chamber, a second impingement unit arranged in the second region and comprising a second impingement plate facing the inner shroud defining a second impingement chamber therebetween, and at least one connector flow channel configured to direct cooling air from the first impingement chamber to the second region, wherein the second impingement plate is configured to receive cooling air from the at least one connector flow channel and form impingement jet directed to the second impingement chamber.

The inner shroud may include a first impingement cavity in the lower surface of the inner shroud in the first region, and the first impingement chamber may include the first impingement cavity.

The inner shroud may include a second impingement cavity in the lower surface of the inner shroud in the second region, and the second impingement chamber may include the second impingement cavity.

The first impingement cavity and the second impingement cavity may be separated by an intervening section of the inner shroud. The at least one connector flow channel may extend through the intervening section of the inner shroud.

The second impingement plate may be arranged to be flush with an opening of the second impingement cavity. Alternatively, the second impingement plate may be arranged within the second impingement cavity.

The at least one connector flow channel may extend through the seal unit.

The seal unit may include at least one of a seal support lug extending radially inward from the lower surface of the inner shroud, and a seal plate supported at and arranged radially inward from the inner shroud. The at least one connector flow channel may extend through at least one of the seal support lug and the seal plate.

A width of the at least one connector flow channel may be between 2% and 40% of a width of the seal support lug or the seal plate measured along a circumferential direction of the inner shroud.

The second impingement unit may include a cover plate arranged radially inward the second impingement plate and facing the second impingement plate and defining a cooling air receiving chamber therebetween. An outlet of the at least one connector flow channel may be positioned in the cooling air receiving chamber.

The lower surface of the inner shroud in the first region may include a base opening of an airfoil of the turbine vane. The first impingement chamber and the base opening of the airfoil may be non-overlapping.

A radial distance of the second impingement plate from the lower surface of the inner shroud may be less than or equal to a radial distance of the first impingement plate from the lower surface of the inner shroud. A diameter of second impingement holes of the second impingement plate may be smaller than a diameter of first impingement holes of the first impingement plate.

The inner shroud may include at least one shroud cooling hole having an inlet positioned in the second impingement chamber and an outlet positioned in the upper surface of the inner shroud or in a side surface of the inner shroud.

According to an aspect of another exemplary embodiment, there is provided a gas turbine including: a compressor configured to compress air introduced thereinto from an outside; a combustor configured to mix fuel with air compressed by the compressor for combustion; and a turbine including a plurality of turbine vanes and a plurality of turbine blades mounted on blade carrying disks and rotated by combustion gas produced by the combustor. Each of turbine vane may include: an inner shroud having an upper surface and a lower surface; a seal unit disposed in the lower surface of the inner shroud and defining a first region and a second region in the lower surface of the inner shroud; a first impingement unit arranged in the first region and comprising a first impingement plate facing the inner shroud defining a first impingement chamber therebetween, wherein the first impingement plate is configured to receive cooling air and form impingement jet directed to the first impingement chamber; a second impingement unit arranged in the second region and comprising a second impingement plate facing the inner shroud defining a second impingement chamber therebetween; and at least one connector flow channel configured to direct cooling air from the first impingement chamber to the second region, wherein the second impingement plate is configured to receive cooling air from the at least one connector flow channel and form impingement jet directed to the second impingement chamber.

The inner shroud may include a first impingement cavity in the lower surface of the inner shroud in the first region, and the first impingement chamber may include the first impingement cavity.

The inner shroud may include a second impingement cavity in the lower surface of the inner shroud in the second region, and the second impingement chamber may include the second impingement cavity.

The first impingement cavity and the second impingement cavity may be separated by an intervening section of the inner shroud, and the at least one connector flow channel may extend through the intervening section of the inner shroud.

The second impingement plate may be arranged to be flush with an opening of the second impingement cavity, or the second impingement plate may be arranged within the second impingement cavity.

The at least one connector flow channel may extend through the seal unit.

The gas turbine may further include an interstage seal axially disposed between the blade carrying disk and the turbine vane. The second impingement unit may be positioned in a space defined by the inner shroud of the turbine vane, the seal unit and the interstage seal, and the interstage seal may be configured to seal the space at radially inner side of the space.

The first impingement plate may be configured to receive cooling air from a last stage of the compressor.

BRIEF DESCRIPTION OF THE DRAWINGS

The above and other aspects will become more apparent from the following description of the exemplary embodiments with reference to the accompanying drawings, in which.

DETAILD DESCRIPTION

Figure 1:
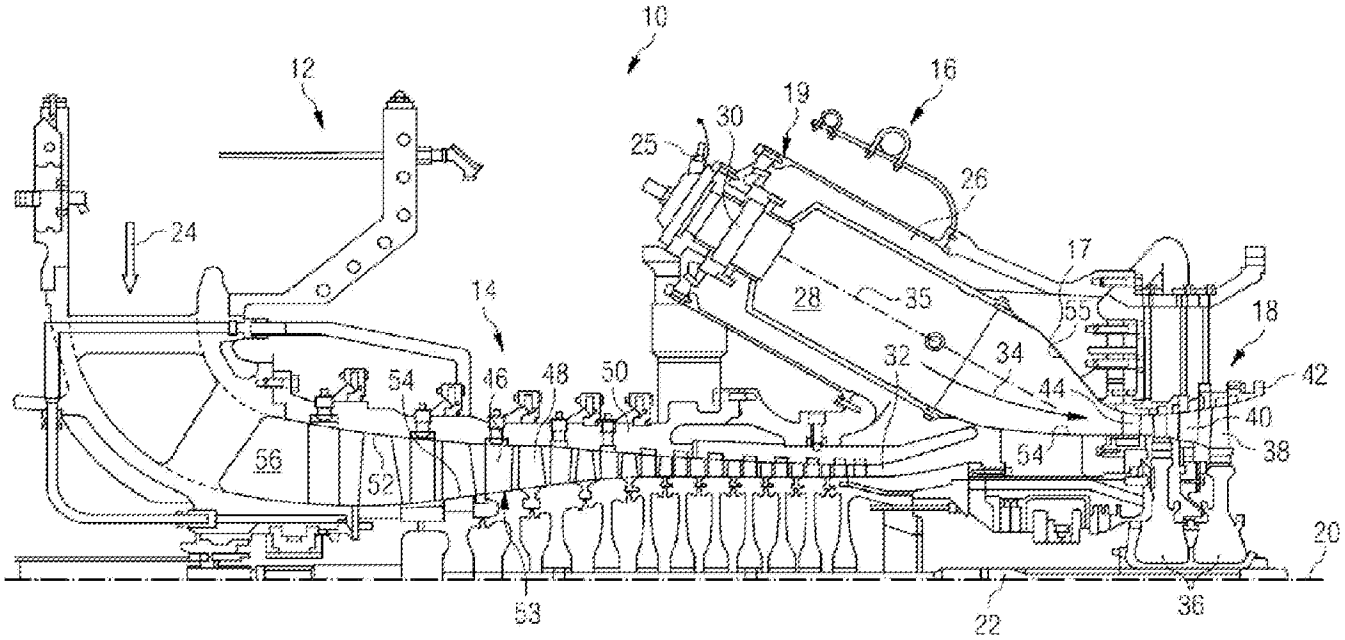
FIG. 1 is a sectional view of a part of a gas turbine including a turbine vane according to an exemplary embodiment.
Figure 2:
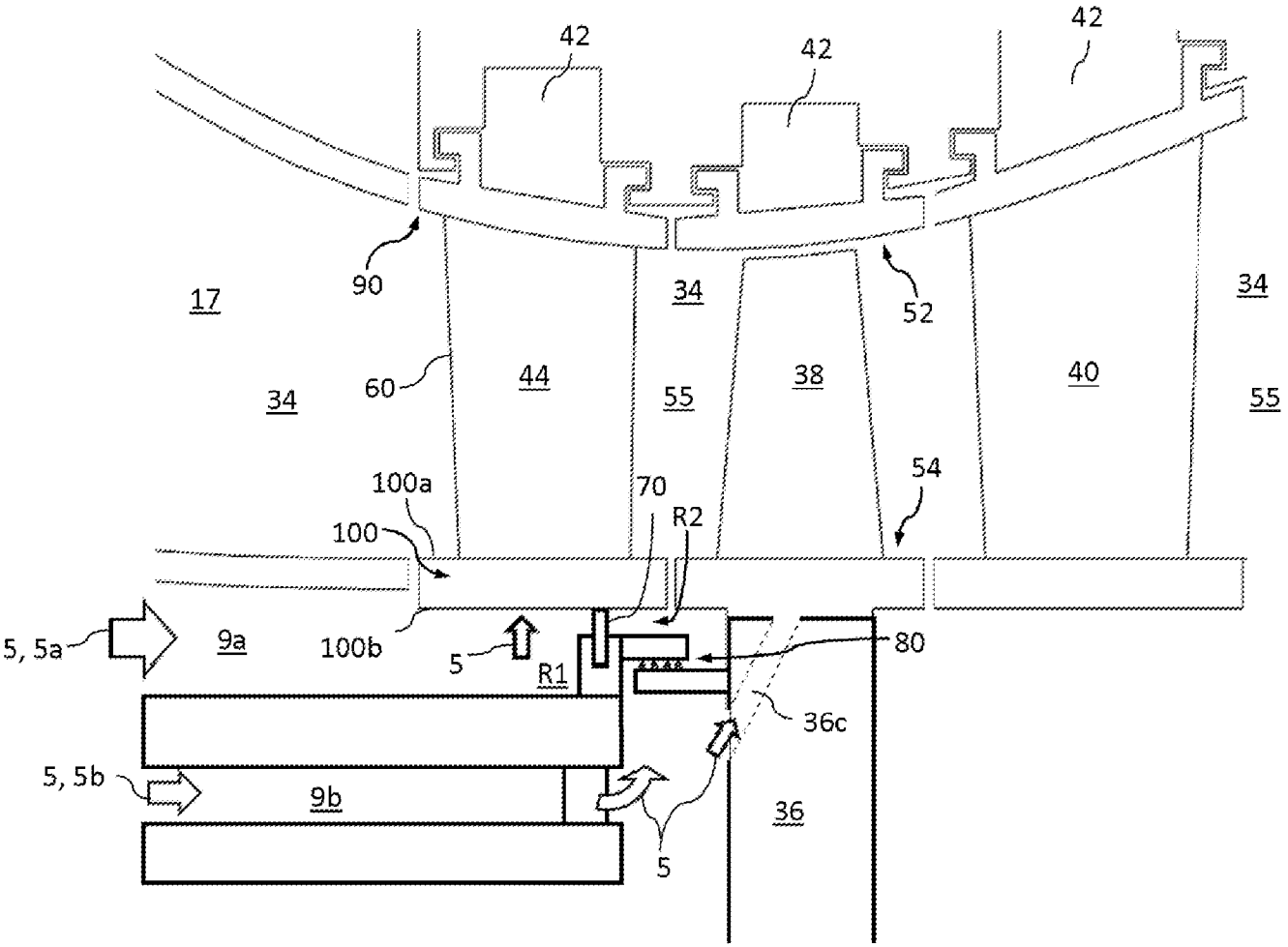
FIG. 2 (PRIOR ART)
FIG. 2 schematically illustrates a related art cooling scheme for an inner shroud of a turbine vane.

Various modifications and various embodiments will be described below in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

The terminology used herein is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, all of a, b, and c, or any variations of the aforementioned examples.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, exemplary embodiments will be described below in detail with reference to the accompanying drawings. It should be noted that like reference numerals refer to like parts throughout the various figures and exemplary embodiments. In certain embodiments, a detailed description of functions and configurations well known in the art may be omitted to avoid obscuring appreciation of the disclosure by a person of ordinary skill in the art. For the same reason, some components may be exaggerated, omitted, or schematically illustrated in the accompanying drawings.

FIG. 1 is a sectional view of a part of a gas turbine 10 including a turbine vane according to an exemplary embodiment. Referring to FIG. 1, the gas turbine 10 may include an inlet 12, a compressor section 14, a combustion section 16 and a turbine section 18 arranged in the direction of a rotational axis 20. The gas turbine 10 may further include a shaft 22 rotatable about the rotational axis 20 and extending in a longitudinal direction. The shaft 22 may connect the turbine section 18 to the compressor section 14.

The compressor section 14 may suck air 24 through the air inlet 12, compress the air, and supply the compressed air to the combustion section 16. The combustion section 16 may include a burner plenum 26, one or more combustion chambers 28 and at least one burner 30 fixed to each combustion chamber 28. The combustion chambers 28 and the burners 30 may be located inside the burner plenum 26. The compressed air passing through the compressor section 14 may enter a diffuser 32 and exit the burner plenum 26, where a portion of the air may enter the burner 30 and mix with a gas or liquid fuel. The air/fuel mixture is burned and combustion gas 34 discharged from the combustion section 16 is supplied to the turbine section 18 via a transition duct 17.

A plurality of combustors constituting the combustion section 16 may be arranged in a form of a shell in a housing. Each of the combustors may include the burner 30 having a fuel injection nozzle and the like, a combustor liner defining the combustion chamber 28, and the transition duct 17 serving as a connector between the combustion section 16 and the turbine section 18.

The turbine section 18 may include a plurality of blade carrying disks 36 attached to the shaft 22. FIG. 1 shows two disks 36 each carrying an annular array of turbine blades 38, and it is understood that more or less than two disks may be included in one or more other embodiments. In addition, turbine vanes 40, 44 fixed to a stator 42 of the gas turbine 10 may be disposed between the turbine blades 38 to guide a flow direction of the combustion gas passing through the turbine blades 38.

The combustion gas discharged from the combustion chamber 28 is supplied to the turbine section 18. The supplied combustion gas expands and applies impingement or reaction force to turbine blades 38 to generate rotational torque. That is, the supplied combustion gas drives the turbine blades 38 which in turn rotates the shaft 22. A portion of the rotational torque is transmitted to the compressor section 14, and remaining portion which is the excessive torque is used to drive a generator or the like.

The compressor section 14 may be driven by some of power output from the turbine section 18. The compressor section 14 may include an axial series of vane stages 46 and rotor blade stages 48. The rotor blade stages 48 may include a rotor disc supporting an annular array of blades. The compressor section 14 may further include a casing 50 that surrounds the rotor stages and supports the vane stages 48. The vane stages 46 may include an annular array of radially extending compressor vanes mounted to the casing 50 in such a way that the compressor vanes form each stage. The compressor vanes guide the compressed air transferred from compressor blade disposed at a preceding stage, to compressor blade disposed at a following stage. In an exemplary embodiment, at least some of the compressor vanes may be mounted so as to be rotatable within a predetermined range, e.g., to adjust the inflow rate of air. The casing 50 may define a radially outer surface 52 of a passage 56 of the compressor section 14. A radially inner surface 54 of the passage 56 may be defined at least in part by a rotor drum 53 of the rotor which may be defined in part by the annular array of blades 48.

The exemplary embodiment shows the gas turbine having a single shaft connecting single/multi-stage compressor and single/one or more stage turbine, and it is understood that two or three shaft engines may be included in one or more other embodiments.

The terms upstream and downstream refer to the flow direction of the airflow and/or working gas flow through the gas turbine. The terms forward and rearward refer to the flow direction of hot gas through the gas turbine. The terms axial, radial and circumferential are made with reference to the rotational axis 20 of the gas turbine.

Figure 3:
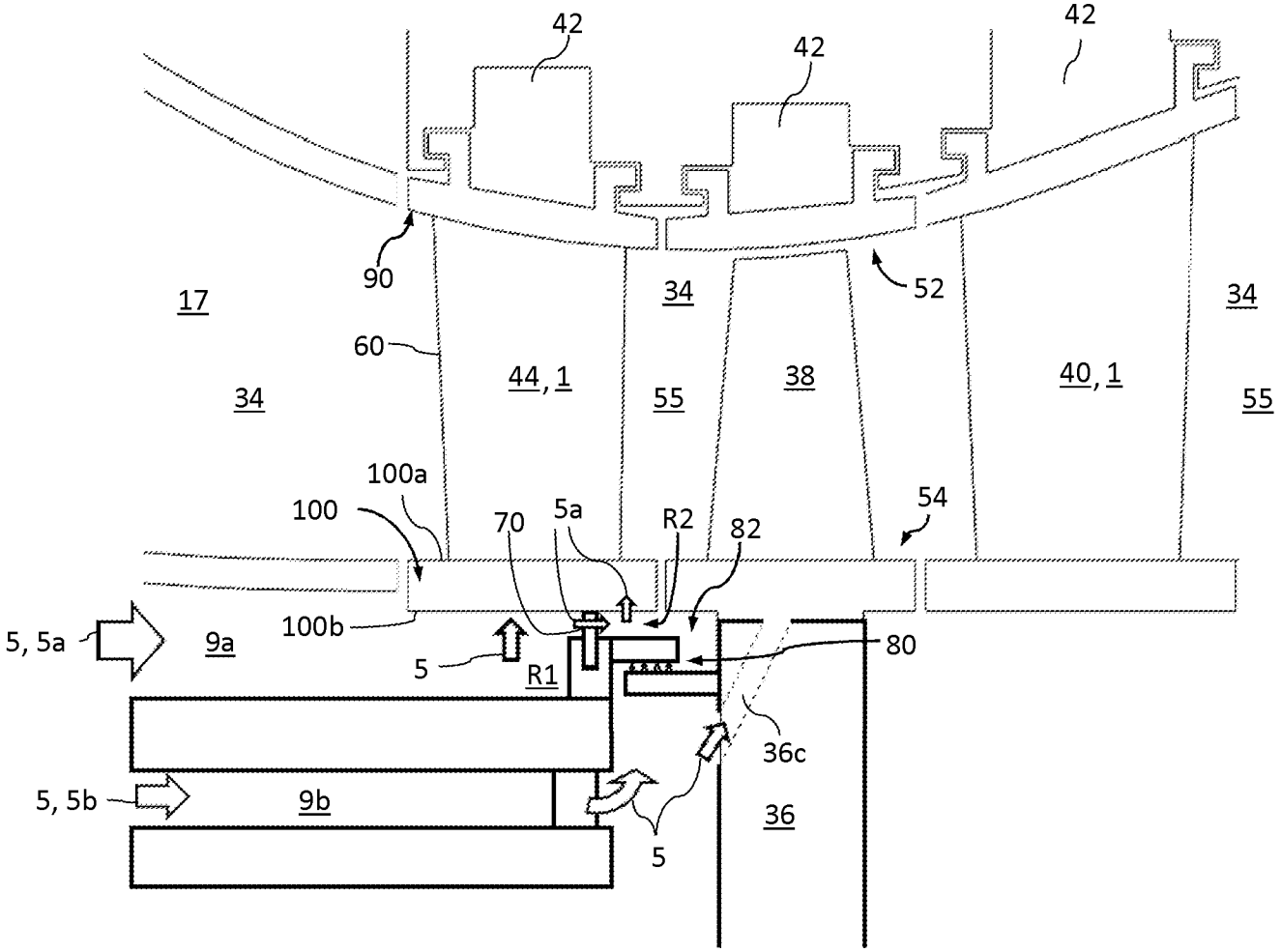
FIG. 3 schematically illustrates a cooling scheme for an inner shroud of a turbine vane according to an exemplary embodiment.
Figure 4:
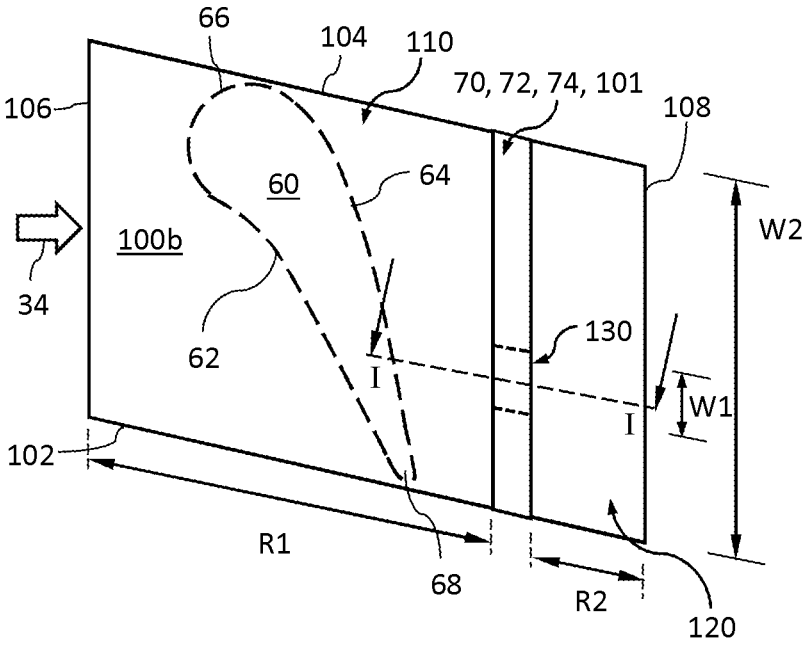
FIG. 4 schematically illustrates a bottom view of the turbine vane according to an exemplary embodiment.
Figure 5:
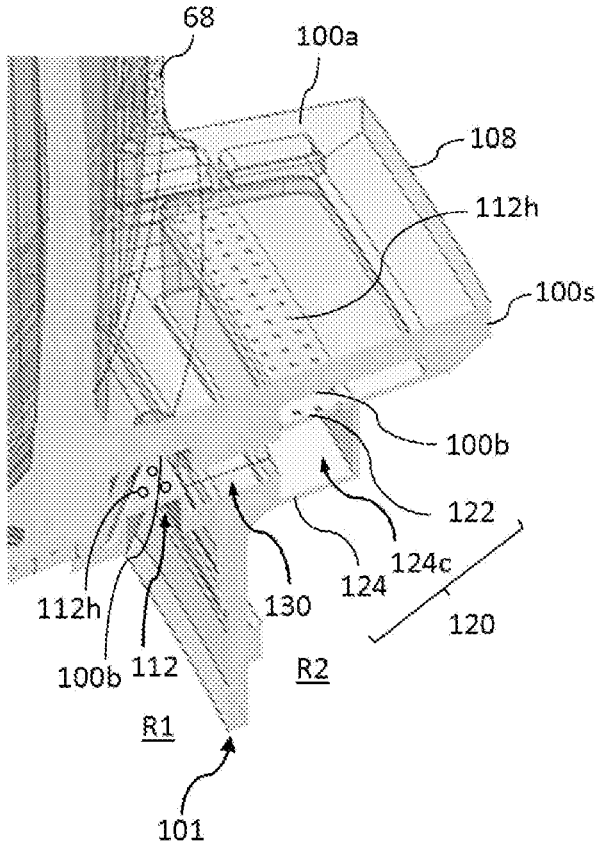
FIG. 5 illustrates a cross-sectional view at line I-I of the turbine vane of FIG. 4.
Figure 6A:
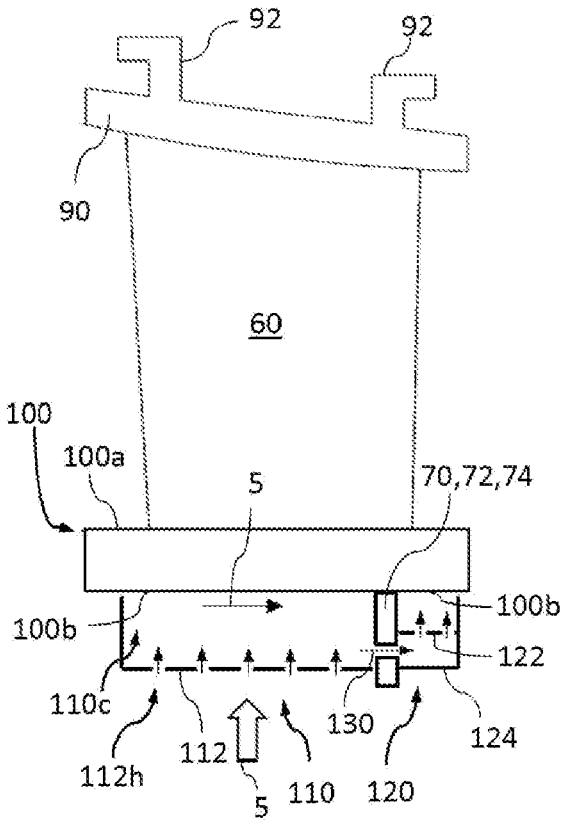
FIGS. 6A to 6C schematically illustrate cross-sectional views according to another exemplary embodiments.
Figure 6B:
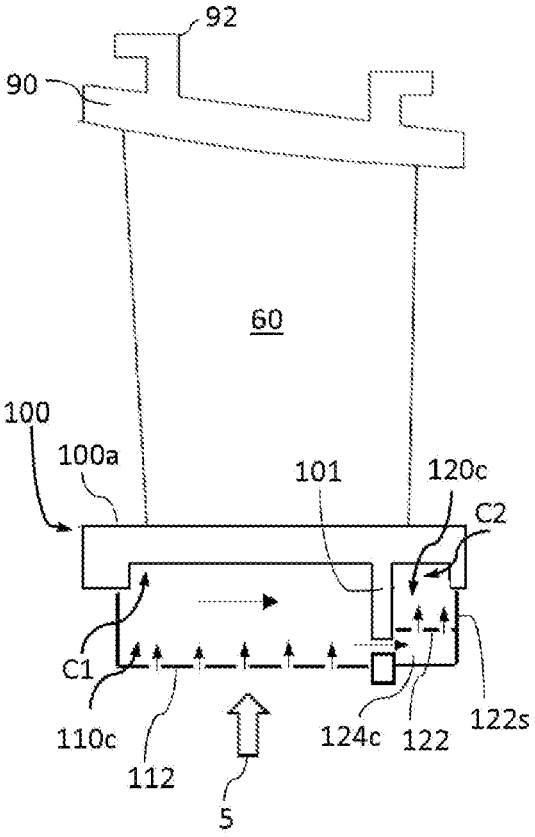
Figure 6C:
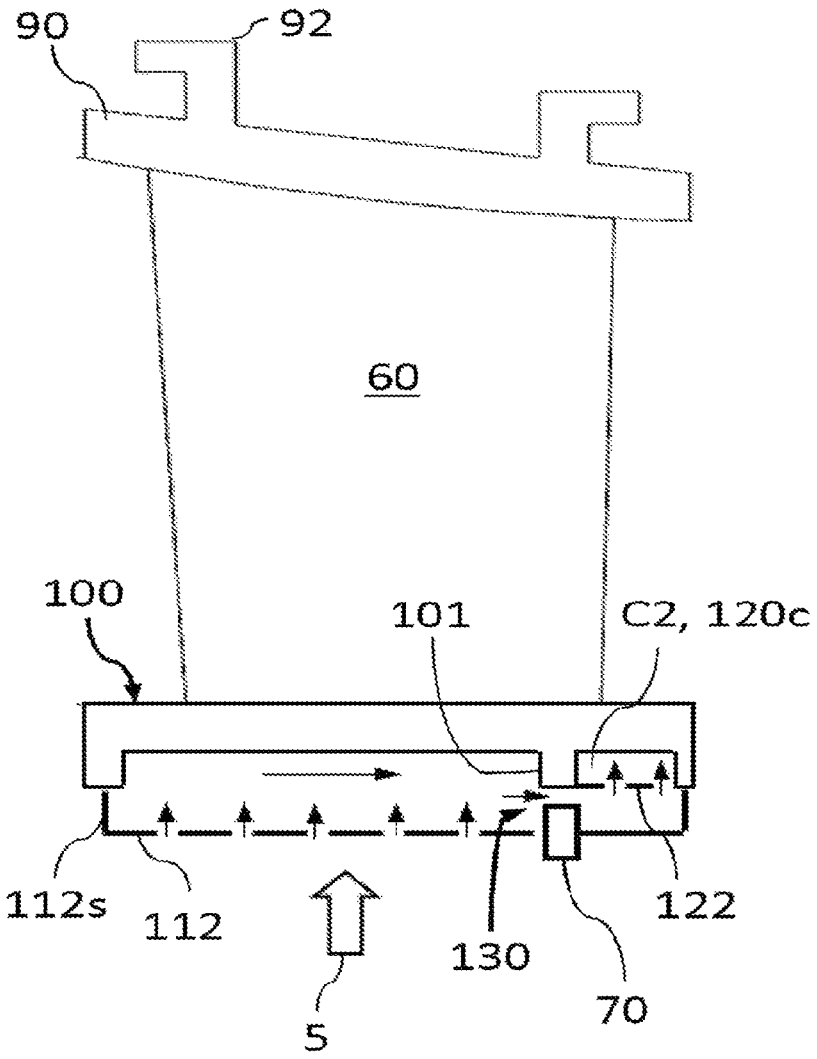
Figure 7:
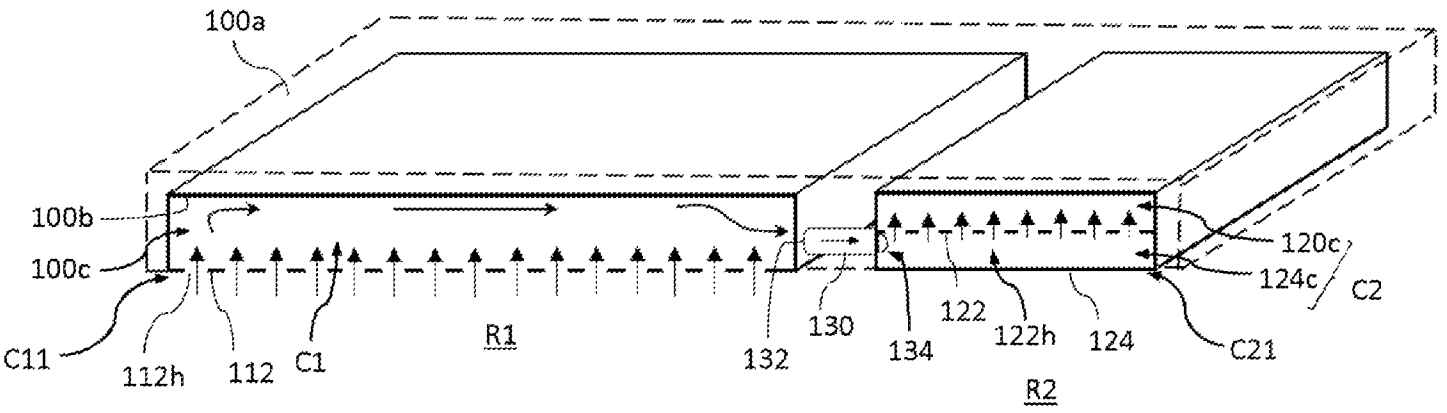
FIG. 7 schematically illustrates a flow of cooling air within the inner shroud of the turbine vane according to an exemplary embodiment.

FIG. 3 schematically illustrates a cooling scheme for an inner shroud of a turbine vane according to an exemplary embodiment. FIG. 4 schematically illustrates a bottom view of the turbine vane according to an exemplary embodiment. FIG. 5 illustrates a cross-sectional view at line I-I of the turbine vane of FIG. 4. FIGS. 6A to 6C schematically illustrate cross-sectional views according to another exemplary embodiments. FIG. 7 schematically illustrates a flow of cooling air within the inner shroud of the turbine vane according to an exemplary embodiment.

Referring to FIGS. 3, 4, and 6A to 6C, a turbine vane 1 which may be the turbine vane 40, 44 of the gas turbine 10 may include an airfoil 60 extending between an inner shroud 100 and an outer shroud 90.

Referring to FIGS. 3 and 4, the turbine vane 1 includes the inner shroud 100, a seal unit 70, a first impingement unit 110, a second impingement unit 120, and at least one connector flow channel 130.

The inner shroud 100 has an upper surface 100*a* and a lower surface 100*b*. The turbine vane 1 may include the airfoil 60 extending from the upper surface 100*a* of the inner shroud 100 to the outer shroud 90.

The inner shroud 100 may be a radially inner shroud 100 with respect to the rotational axis 20 of the gas turbine 10. The inner shroud 100 forms a radially inner surface 54 of an annular hot gas flow path 55 of the turbine 10. The outer shroud 90 may be a radially outer shroud 90 with respect to the rotational axis 20 of the gas turbine 10. The outer shroud forms a radially outer surface 54 of the annular hot gas flow path 55 of the turbine 10. The inner and the outer shrouds 100, 90 define the hot gas flow path 55, i.e., the annular shape of the gas flow path, through which the combustion gas 34 flows in the turbine section 18 of the gas turbine 10.

The upper surface 100*a* of the inner shroud 100 faces the hot gas path 55, and the lower surface 100*b* of the inner shroud 100 faces the rotational axis 20 of the gas turbine 10. The upper surface 100*a* and the lower surface 100*b* of the inner shroud 100 are radially spaced apart and face opposite directions.

Referring to FIG. 4, the airfoil 60 has a pressure wall 62 and a suction wall 64 meeting at a leading edge 66 and a trailing edge 68. The inner shroud 100 may include a pressure-wall side 102, a suction-wall side 104, a leading-edge side 106 and a trailing-edge side 108.

The pressure-wall side 102, the suction-wall side 104, the leading-edge side 106 and the trailing-edge side 108 of the inner shroud 100 may correspond to the pressure wall 62, the suction wall 64, the leading edge 66 and the trailing edge 68 of the airfoil 60, respectively.

The seal unit 70 is disposed at the lower surface 100*b* of the inner shroud 100 and defines a first and a second regions R1, R2 at the lower surface 100*b* of the turbine vane 1. The seal unit 70 seals the first region R1 from the second region R2 with respect to a flow of cooling air 5 from the first region R1 to the second region R2. The turbine vane 1 and the seal unit 70 may be referred to a turbine vane arrangement.

The seal unit 70 may be disposed between the leading-edge side 106 and the trailing-edge side 108, i.e., spaced apart from the leading-edge side 106 and the trailing-edge side 108 and extending from the pressure-wall side 102 to the suction-wall side 104 of the inner shroud 100. Thus, the seal unit 70 defines the first region R1 between the leading-edge side 106 and the seal unit 70 and the second region R2 between the seal unit 70 and the trailing-edge side 108 at the lower surface 100*b* of the inner shroud 100.

For example, the seal unit 70 defines the first region R1 between the leading-edge side 106, the pressure-wall side 102, the suction-wall side 104 and the seal unit 70, and the second region R2 between the seal unit 70, the trailing-edge side 108, the pressure-wall side 102 and the suction-wall side 104 at the lower surface 100*b* of the inner shroud 100.

An upper surface of the first and the second regions R1, R2 may be defined by the lower surface 100*b* of the inner shroud 100.

Referring to FIGS. 6A to 6C, the first impingement unit 110 arranged in the first region R1 includes a first impingement plate 112 facing the lower surface 100*b* of the inner shroud 100. The first impingement plate 112 is radially spaced apart from the lower surface 100*b* of the inner shroud 100. A first impingement chamber 110*c* is defined between the lower surface 100*b* of the inner shroud 100 and the first impingement plate 112 in the first region R1.

The first impingement plate 112 may include a plurality of first impingement holes 112*h*, i.e., through-holes, for generating impingement jets. The first impingement plate 112 receives cooling air 5 from the compressor section 14 and forms impingement jets as the cooling air 5 passes through the first impingement holes 112*h*. The impingement jets are ejected into the first impingement chamber 110*c*. The impingement jets impinge on the surface of the inner shroud 100, e.g., the lower surface 100*b* of the inner shroud 100, thereby cooling the inner shroud 100, i.e., a first portion of the inner shroud 100 corresponding to the first region R1.

The second impingement unit 120 arranged in the second region R2 includes a second impingement plate 122 facing the lower surface 100*b* of the inner shroud 100.

The second impingement plate 122 is radially spaced apart from the lower surface 100*b* of the inner shroud 100. A second impingement chamber 120*c* is defined between the lower surface 100*b* of the inner shroud 100 and the second impingement plate 122 in the second region R2.

The first and second impingement units 110, 120 may be spaced apart from each other by the seal unit 70 and/or by an intervening section 101 of the inner shroud 100.

Referring to FIGS. 6A to 6C and 7, the at least one connector flow channel 130 may have an inlet 132 positioned in the first impingement chamber 100*c* for receiving cooling air 5 from the first impingement chamber 100*c* and an outlet 134 positioned in the second region R2 to direct cooling air 5 from the first impingement chamber 100*c* to the second region R2.

The connector flow channel 130 may be formed as a tubular structure or tube or a through-hole or hollow piping, i.e., a pipe.

The second impingement plate 122 may include a plurality of second impingement holes 122*h*, i.e., through-holes, for generating impingement jets. The second impingement plate 122 receives cooling air 5 from the first impingement chamber 110*c* via the connector flow channel 130 and forms impingement jets as the cooling air 5 passes through the second impingement holes 122*h*. The impingement jets are ejected into the second impingement chamber 120*c*. The impingement jets impinge on the surface of the inner shroud 100, e.g., the lower surface 100*b* of the inner shroud 100, thereby cooling the inner shroud 100, i.e., a second portion of the inner shroud 100 corresponding to the second region R2.

For example, the cooling air 5 flows towards the first impingement plate 112, passes through the first impingement holes 112*h* to generate impingement jets that is ejected into the first impingement chamber 110*c* toward the inner shroud 100, flows into the inlet 132 of the connector flow channel 130 and through the connector flow channel 130 from the first impingement chamber 110*c* to the second region R2, exits the outlet 134 of the connector flow channel 130 in the second region R2, flows toward the second impingement plate 122, and passes through the second impingement holes 122*h* to generate impingement jets that is ejected into the second impingement chamber 120*c* toward the inner shroud 100.

Therefore, as shown in FIG. 3, the portion 5*a* of the cooling air 5 is used to impinge the lower surface 100*b* of the inner shroud 100 in the first impingement chamber 110*c* in the first region R1 and is directed to the second region R2 via the connector flow channel 130 across the seal unit 70, and flows through the second impingement plate 120 into the second impingement chamber 120*c* in the form of impingement jets. Therefore, the same cooling air is used to perform impingement cooling twice. First, cooling the lower surface 100*b* of the inner shroud 100 in the first region R1, i.e., the first portion of the inner shroud 100, and then cooling the lower surface 100*b* of the inner shroud 100 in the second region R2, i.e., the second portion of the inner shroud 100.

Because the lower surface 100*b* of the inner shroud 100 is cooled both the first and the second regions R1, R2 by impingement cooling, the cooling efficiency is improved. Further, the same portion or volume of the cooling air is used for impingement cooling in both the first and the second regions R1, R2, so that there is no need to draw additional cooling air from the compressor for separate cooling of the portion of the inner shroud corresponding to the second region R2.

In FIG. 3, a portion 5*b* of cooling air 5 is transmitted through a second flow channel 9*b* to a turbine blade 38 located downstream of the turbine vane 1 via a cooling air channel 36*c* formed through a blade carrying disk 36. An interstage seal 80, also referred to as a radial seal such as a labyrinth seal 80, is disposed between the turbine vane 1 and the blade carrying disk 36, and is configured to block flow of cooling air 5 in the radial direction between a vane stage comprising the turbine vane 1 and a blade stage comprising the blade 38 and the blade carrying disk 36.

The second impingement unit 120 may be positioned within a space 82 defined by the inner shroud 100 of the turbine vane 1, the seal unit 70 and the interstage seal 80, and a platform of the blade 38 and blade carrying disk 36.

Referring to FIGS. 5 and 6A to 6C, the first impingement unit 110 may be formed such that the first impingement chamber 110*c* has an inlet for cooling air via the first impingement holes 112*h*, preferably, only via the first impingement holes 112*h*. That is, the first impingement chamber 110*c* has no inlet other than the first impingement holes 112*h* for receiving cooling air. However, it is understood that the configuration of the first impingement chamber 110*c* is not limited to example described above and may be changed or vary according to one or more other exemplary embodiments.

The first impingement unit 110 may be formed such that the first impingement chamber 110*c* has an outlet for cooling air via the connector flow channel 130, preferably, via only the inlet 132 of the connector flow channel 130. That is, there is no other outlet for ejecting cooling air to outside of the first chamber 110*c* except through the connector flow channel 130 in the first impingement chamber 110*c*. However, it is understood that the configuration of the first impingement chamber 110*c* is not limited to example described above and may be changed or vary according to one or more other exemplary embodiments. For example, there is a cooling hole extending from the first impingement chamber 110*c* into the hot gas path 55.

The second impingement unit 120 may be formed such that the second impingement chamber 120*c* has an inlet for cooling air via the second impingement holes 122*h*, preferably, only via the second impingement holes 122*h*. That is, the second impingement chamber 120*c* has no other inlet for receiving cooling air except the second impingement holes 122*h*. However, it is understood that the configuration of the second impingement chamber 120*c* is not limited to example described above and may be changed or vary according to one or more other exemplary embodiments.

The second impingement unit 120 may include a cover plate 124 disposed radially inward of the second impingement plate 122 and facing the second impingement plate 122. That is, the cover plate 124 may be disposed between the second impingement plate 122 and the rotational axis 20 of the gas turbine 10. The cover plate 124 may be radially spaced apart from the second impingement plate 122 to define a cooling air receiving chamber 124*c* therebetween, i.e., between the second impingement plate 122 and the cover plate 124.

The second impingement chamber 120*c* may be disposed radially outward of the cooling air receiving chamber 124*c* and may be radially aligned. The second impingement chamber 120*c* and the cooling air receiving chamber 124*c* may be fluidly connected only by the second impingement holes 122*h*.

The cooling air receiving chamber 124*c* may be formed such that the cooling air receiving chamber 124*c* has an inlet for cooling air via the connector flow channel 130, preferably, only via the connector flow channel 130. That is, the cooling air receiving chamber 124*c* has no other inlet for receiving cooling air except the connector flow channel 130, e.g., the outlet 134 of the connector flow channel 130. However, it is understood that the configuration of the cooling air receiving chamber 124*c* is not limited to example described above and may be changed or vary according to one or more other exemplary embodiments.

The cooling air receiving chamber 124*c* may be formed such that the cooling air receiving chamber 124*c* has an outlet for cooling air via the second impingement holes 122*h*, preferably, only via the second impingement holes 122*h*. That is, the cooling air receiving chamber 124*c* has no other outlet for ejecting cooling air except the second impingement holes 122*h*. However, it is understood that the configuration of the cooling air receiving chamber 124*c* is not limited to example described above and may be changed or vary according to one or more other exemplary embodiments.

Referring to FIG. 7, the inlet 132 of the connector flow channel 130 may be positioned in the first impingement chamber 110*c*, and the outlet 134 of the connector flow channel 130 may be positioned in the cooling air receiving chamber 124*c*.

As shown in FIGS. 6B, 6C and 7, the lower surface 100*b* of the inner shroud 100 in the first region R1 may include a first impingement cavity C1. In other words, the first impingement chamber 110*c* may include the first impingement cavity C1.

The first impingement plate 112 may be positioned at an opening C11 of the first impingement cavity C1. In other words, the first impingement plate 112 may be formed as a flat sheet or planar surface and may be flush with the opening C11 of the first impingement cavity C1, i.e., completely covers the opening C11 of the first impingement cavity C1. That is, the first impingement plate 112 may completely seal the opening C11 of the first impingement cavity C1 except for the cooling air flowing through the first impingement holes 112*h*.

Alternatively, the first impingement plate 112 may be positioned outside the first impingement cavity C1, i.e., radially spaced apart from the opening C11 of the first impingement cavity C1. The first impingement unit 110 may include flanking plate members 112*s* that extend radially between the first impingement plate 112 and the lower surface 100*b* of the inner shroud 100 surrounding the first impingement cavity C1 with the first impingement chamber 110*c*. The first impingement plate 112 and the flanking plate member 112*s* may completely seal the opening C11 of the first impingement cavity C1 except for the cooling air flowing through the first impingement holes 112*h*.

Also, the first impingement plate 112 may be positioned radially inside the first impingement cavity C1, i.e., between the lower surface 100*b* of the inner shroud 100 and the opening C11 of the first impingement cavity C1. The first impingement plate 112 may completely seal a portion of the first impingement cavity C1 disposed between the first impingement plate 112 and the lower surface 100*b* of the inner shroud 100 except for the cooling air flowing through the first impingement holes 112*h*.

Here, the lower surface 100*b* of the inner shroud 100 in the second region R2 may include a second impingement cavity C2. In other words, the second impingement chamber 120*c* may include the second impingement cavity C2.

The second impingement plate 122 may be positioned at or within or outside the second impingement cavity C2.

The second impingement plate 122 may be positioned at an opening C21 of the second impingement cavity C2. In other words, the second impingement plate 122 may be formed as a flat sheet planar surface and may be flush with the opening C21 of the second impingement cavity C2, i.e., completely covers the opening C21 of the second impingement cavity C2. That is, the second impingement plate 122 may completely seal the opening C21 of the second impingement cavity C2 except for the cooling air flowing through the second impingement holes 122*h*.

Alternatively, the second impingement plate 122 may be positioned outside the second impingement cavity C2, i.e., radially spaced apart from the opening C21 of the second impingement cavity C2. The second impingement unit 120 may include flanking plate members 122*s* that extend radially between the second impingement plate 122 and the lower surface 100*b* of the inner shroud 100 surrounding the second impingement cavity C2 with the second impingement chamber 120*c*. The second impingement plate 122 and the flanking plate members 122*s* may completely seal the opening C21 of the second impingement cavity C2 except for the cooling air flowing through the second impingement holes 122*h*.

Also, the second impingement plate 122 may be positioned radially inside the second impingement cavity C2, i.e., between the lower surface 100*b* of the inner shroud 100 and the opening C21 of the second impingement cavity C2. The second impingement plate 122 may completely seal a portion of the second impingement cavity C2 disposed between the second impingement plate 122 and the lower surface 100*b* of the inner shroud 100 except for the cooling air flowing through the second impingement holes 122*h*.

The cover plate 124 may be positioned at the opening C21 of the second impingement cavity C2. In other words, the cover plate 124 may be formed as a flat sheet or planar surface and may be flush with the opening C21 of the second impingement cavity C2, i.e., completely covers the opening C21 of the second impingement cavity C2. That is, the cover plate 124 may completely seal a portion of the second impingement cavity C2 disposed between the second impingement plate 122 and the cover plate 124 of the inner shroud 100 except for the cooling air flowing through the second impingement holes 122*h*.

Referring to FIGS. 4 and 6A, the connector flow channel 130 may axially extend through the seal unit 70. The seal unit 70 may include at least one of a seal support lug 72 and a seal plate 74.

The seal support lug 72 may extend radially inward from the lower surface 100*b* of the inner shroud 100. The seal support lug 72 may define the first region R1 and the second region R2. The connector flow channel 130 may extend through the seal support lug 72. The seal plate 74 may be supported at or attached to the seal support lug 72, preferably at a radially outer end of the seal plate 74. A radially inner end of the seal plate 74 may be supported by a seal housing. The connector flow channel 130 may be formed as a through-hole passing through the seal support lug 72, or may be formed as a separate tubular structure or tube inserted through a through-hole formed in the seal support lug 72.

The seal plate 74 may not have any connector flow channel formed therethrough. Alternatively, a further connector flow channel may extend through the seal plate 74.

The seal plate 74 may extend radially inward from the lower surface 100*b* of the inner shroud 100 or from the seal support lug 72. The seal plate 74 may define the first region R1 and the second region R2. The connector flow channel 130 may extend through the seal plate 74. The seal plate 74 may be supported at or attached to the lower surface 100*b* of the inner shroud 100 or to the seal support lug 72, preferably at a radially outer end of the seal plate 74. A radially inner end of the seal plate 74 may be supported by a seal housing. The connector flow channel 130 may be formed as a through-hole passing through the seal plate 74, or may be formed as a separate tubular structure or tube inserted through a through-hole formed in the seal plate 74.

The seal support lug 72 may not have any connector flow channel formed therethrough. Alternatively, a further connector flow channel may extend through the seal support lug 72.

Referring to FIGS. 5 and 6B, the first impingement cavity C1 and the second impingement cavity C2 may be separated by an intervening section 101 of the inner shroud 100. The intervening section 101 of the inner shroud 100 may extend radially inward from the lower surface 100*b* of the inner shroud 100. The connector flow channel 130 may axially extend through the intervening section 101 of the inner shroud 100. In other words, the connector flow channel 130 may be formed as a through-hole in the intervening section 101 of the inner shroud 100. Alternatively, the connector flow channel 130 may be formed as a separate tubular structure or tube inserted through a through-hole formed in the intervening section 101 of the inner shroud 100.

The seal unit 70, preferably at least one, more preferably both of seal support lug 72 and the seal plate 74, may be aligned with the intervening section 101 of the inner shroud 100 in the radial direction.

FIG. 4 illustrates exemplary dimensions of the connector flow channel 130 with respect to the seal support lug 72 or the seal plate 74, or separation distance between the pressure-wall side 102 and the suction-wall side 104. Referring to FIG. 4, a width W1 of the connector flow channel 130 is between 2% and 40%, preferably between 5% and 15%, of a width W2 of the seal support lug 72 or the seal plate 74 measured along a circumferential direction of the inner shroud 100. That is, the width W1 is between 2% and 40%, preferably between 5% and 15%, of the separation distance W2 between the pressure-wall side 102 and the suction-wall side 104 of the inner shroud 100 measured at the lower surface 100*b* along the circumferential direction of the inner shroud 100.

FIGS. 3 to 7 show one connector flow channel 130, and it is understood that more than one connector flow channel may be included in one or more other embodiments. Therefore, the cooling air 5 is received in a distributed manner in the second region R2 or the cooling air receiving chamber 124*c* to achieve a more uniform impingement jet formation by the second impingement plate 122.

Figure 8:
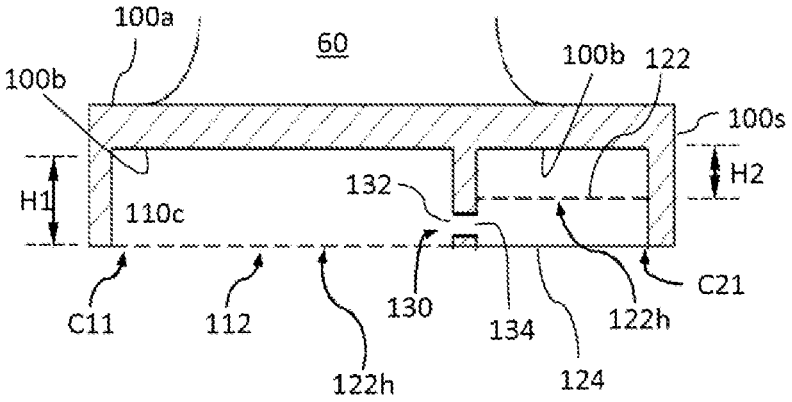
FIG. 8 schematically illustrates a cross-sectional view of a turbine vane according to another exemplary embodiment.
Figure 9A:
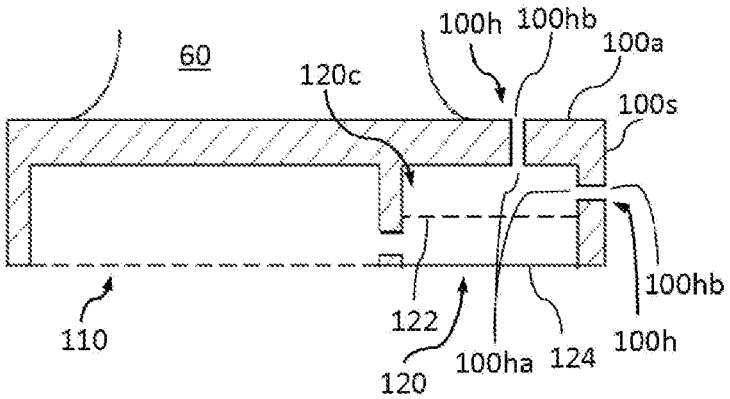
FIGS. 9A to 9B schematically illustrate cross-sectional views of shroud cooling holes of the turbine vane according to an exemplary embodiment.
Figure 9B:
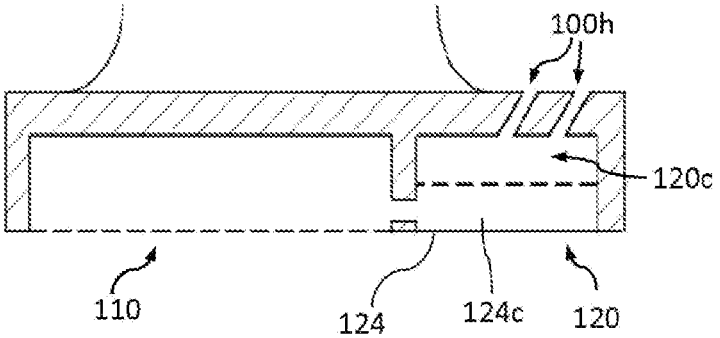
Figure 10:
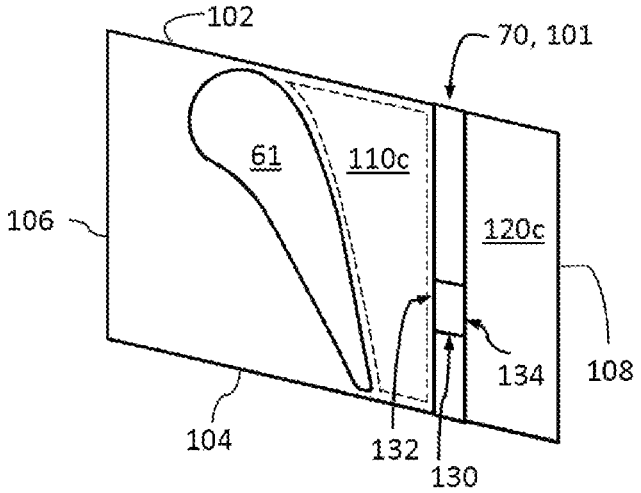
FIG. 10 schematically illustrates a bottom-sectional view of the turbine vane according to an exemplary embodiment.

FIG. 8 schematically illustrates a cross-sectional view of a turbine vane according to another exemplary embodiment. FIGS. 9A to 9B schematically illustrate cross-sectional views of shroud cooling holes of the turbine vane according to an exemplary embodiment. FIG. 10 schematically illustrates a bottom-sectional view of the turbine vane according to an exemplary embodiment.

Referring to FIG. 8, a radial distance H2 of the second impingement plate 122 from the lower surface 100*b* of the inner shroud 100 may be less than or equal to a radial distance H1 of the first impingement plate 112 from the lower surface 100*b* of the inner shroud 100. Accordingly, impingement jets having increased force to collide with the lower surface 100*b* of the inner shroud 100 in the second region R2 may be formed.

A diameter of second impingement holes 122*h* of the second impingement plate 122 may be smaller than a diameter of the first impingement holes 112*h* of the first impingement plate 112.

Referring to FIGS. 9A and 9B, the inner shroud 100 may include at least one shroud cooling hole 100*h* having an inlet 100*ha* positioned in the second impingement chamber 120*c* and an outlet 100*hb* positioned in the upper surface 100*a* of the inner shroud 100 or a side surface 100*s* of the inner shroud 100.

The cooling air from the shroud cooling hole 100*h* may be ejected into the hot gas path 55. The outlet 100*hb* of the shroud cooling hole 100*h* may be positioned at the hot gas path 55.

As shown in FIG. 9A, the inner shroud 100 may include a plurality of shroud cooling holes 100*h*. The inlet 100*ha* of the shroud cooling holes 100*h* may be positioned in the second impingement chamber 120*c* and the outlet 100*hb* may be positioned in the upper surface 100*a* of the inner shroud 100. Alternatively, the inlet 100*ha* of the shroud cooling holes 100*h* may be positioned in the second impingement chamber 120*c* and the outlet 100*hb* may be positioned in the side surface 100*s* of the inner shroud 100.

Here, the shroud cooling holes 100*h* may be straight through-holes with respect to the lower surface 100*b* and the upper surface 100*a* of the inner shroud 100. That is, the shroud cooling holes 100*h* may be radially aligned or radially extended. Alternatively, the shroud cooling holes 100*h* may be straight through-holes with respect to the lower surface 100*b* and the side surface 100*s* of the inner shroud 100. That is, the shroud cooling holes 100*h* may be axially aligned or axially extended.

As shown in FIG. 9B, the shroud cooling holes 100*h* may be inclined through-holes with respect to the lower surface 100*b* and the upper surface 100*a* of the inner shroud 100. That is, the shroud cooling holes 100*h* may be inclined with respect to the radial direction. Alternatively, the shroud cooling hole 100*h* may be inclined through-holes with respect to the lower surface 100*b* and the side surface 100*s* of the inner shroud 100. That is, the shroud cooling holes 100*h* may be inclined with respect to the radial direction.

Referring to FIG. 10, the turbine vane 1 may be formed such that the lower surface 100*b* of the inner shroud 100 in the first region R1 may include a base opening 61 of the airfoil 60. The base opening 61 may be an opening of the inner cavity of the airfoil 60. The inner cavity of the airfoil 60 is the space surrounded by the airfoil shape, i.e., the space defined by the pressure wall 62, the suction wall 64, the leading edge 66 and the trailing edge 68 of the airfoil 60.

The first impingement chamber 110*c* and the base opening 61 of the airfoil 60 may be non-overlapping or discontinuous with respect to each other. In other words, the first impingement chamber 110*c* and the base opening 61 of the airfoil 60 are fluidly separated from each other. That is, the cooling air 5 introduced into the first impingement chamber 110*c* does not flow into the base opening 61 of the airfoil 60.

For example, the first impingement plate 112 may be configured to receive cooling air 5 from a last stage of the compressor section 14.

Figure 11A:
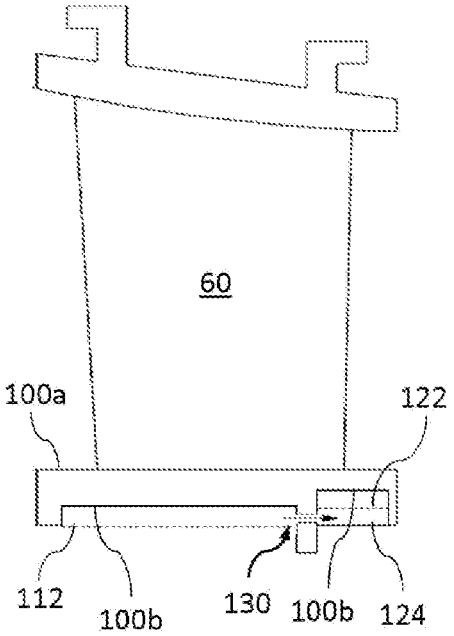
FIGS. 11A to 11C schematically illustrate cross-sectional views of the turbine vane according to another exemplary embodiments.
Figure 11B:
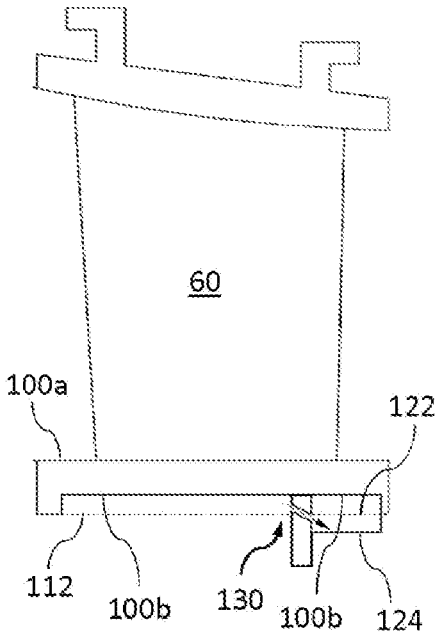
Figure 11C:
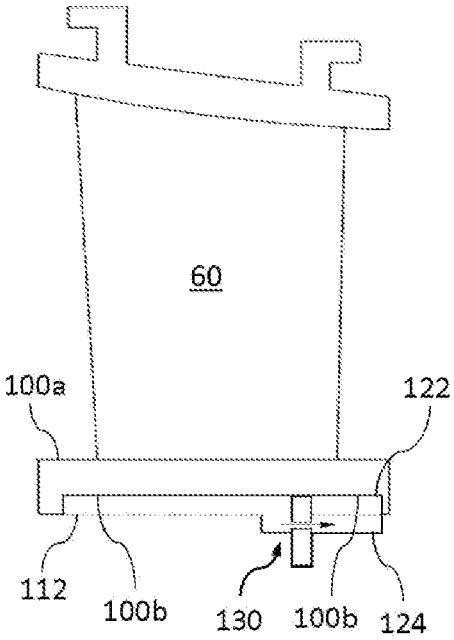

FIGS. 11A to 11C illustrate cross-sectional views of the turbine vane according to another exemplary embodiments. Referring to FIGS. 11A to 11C, the first impingement plate 112 and the second impingement plate 122 are arranged to face the lower surface 100*b* of the inner shroud 100 in the first region R1 and the lower surface 100*b* of the inner shroud 100 in the second region R2, respectively. The cover plate 124 of the second impingement unit 120 is arranged in the second region R2 facing the second impingement plate 122.

As shown in FIG. 11A, the first impingement plate 112 and the cover plate 124 may be flush with each other. In other words, a distance between the upper surface 100*a* of the inner shroud 100 and the first impingement plate 112 may be the same as a distance between the upper surface 100*a* of the inner shroud 100 and the cover plate 124.

The second impingement plate 122 may be disposed between the lower surface 100*b* of the inner shroud 100 and the cover plate 124. A distance between the lower surface 100*b* of the inner shroud 100 and the cover plate 124 in the second region R2 may be greater than a distance between the lower surface 100*b* of the inner shroud 100 and the first impingement plate 112 in the first region R1.

As shown in FIG. 11B, the first impingement plate 112 and the cover plate 124 may not be flush with each other. Alternatively, the first impingement plate 112 and second impingement plate 122 may be flush with each other. In other words, a distance between the first impingement plate 112 and the upper surface 100*a* and/or the lower surface 100*b* of the inner shroud 100 in the first region R1 may be the same as a distance between the second impingement plate 122 and the upper surface 100*a* and/or the lower surface 100*b* of the inner shroud 100 in the second region R2.

The second impingement plate 122 may be disposed between the lower surface 100*b* of the inner shroud 100 and the cover plate 124.

The connector flow channel 130 may be inclined, i.e., inclined from the inlet 132 to the outlet 134 toward the rotational axis of the gas turbine. In other words, the connector flow channel 130 may be formed to be inclined from a radially outer position in the first region R1 to a radially inner position in the second region R2. That is, the connector flow channel 130 may be inclined such that the inlet 132 is disposed at a radially outer position in the first region R1 and the outlet 134 is disposed at a radially inner position in the second region R2.

As shown in FIG. 11C, the first impingement plate 112 may be formed in a stepped manner. That is, a first part of the first impingement plate 112 disposed adjacent to the inlet 132 of the connector flow channel 130 may be disposed at a radially inner position than a second part of the first impingement plate 112 disposed away from the inlet 132 of the connector flow channel 130. The first part of the first impingement plate 112 may be disposed between the second part of the first impingement plate 112 and the connector flow channel 130.

The first part of the first impingement plate 112 may be flush with the cover plate 124, and the second part of the first impingement plate 112 may be flush with the second impingement plate 122.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A turbine vane comprising:

an inner shroud having an upper surface and a lower surface;

a seal unit disposed in the lower surface of the inner shroud and defining a first region and a second region in the lower surface of the inner shroud;

a first impingement unit arranged in the first region and comprising a first impingement plate facing the inner shroud defining a first impingement chamber therebetween, wherein the first impingement plate is configured to receive cooling air and form impingement jet directed to the first impingement chamber;

a second impingement unit arranged in the second region and comprising a second impingement plate facing the inner shroud defining a second impingement chamber therebetween; and at least one connector flow channel configured to direct cooling air from the first impingement chamber to the second region, wherein the second impingement plate is configured to receive cooling air from the at least one connector flow channel and form impingement jet directed to the second impingement chamber, wherein a radial distance of the second impingement plate from the lower surface of the inner shroud is less than a radial distance of the first impingement plate from the lower surface of the inner shroud.

2. The turbine vane according to claim 1, wherein the inner shroud comprises a first impingement cavity in the lower surface of the inner shroud in the first region, and the first impingement chamber includes the first impingement cavity.

3. The turbine vane according to claim 2, wherein the inner shroud comprises a second impingement cavity in the lower surface of the inner shroud in the second region, and the second impingement chamber includes the second impingement cavity.

4. The turbine vane according to claim 3, wherein the first impingement cavity and the second impingement cavity are separated by an intervening section of the inner shroud, and wherein the at least one connector flow channel extends through the intervening section of the inner shroud.

5. The turbine vane according to claim 3, wherein the second impingement plate is arranged to be flush with an opening of the second impingement cavity, or the second impingement plate is arranged within the second impingement cavity.

6. The turbine vane according to claim 1, wherein the at least one connector flow channel extends through the seal unit.

7. The turbine vane according to claim 1, wherein the seal unit comprises at least one of a seal support lug extending radially inward from the lower surface of the inner shroud, and a seal plate supported at and arranged radially inward from the inner shroud, and wherein the at least one connector flow channel extends through at least one of the seal support lug and the seal plate.

8. The turbine vane according to claim 7, wherein a width of the at least one connector flow channel is between 2% and 40% of a width of the seal support lug or the seal plate measured along a circumferential direction of the inner shroud.

9. A turbine vane comprising:

an inner shroud having an upper surface and a lower surface;

a seal unit disposed in the lower surface of the inner shroud and defining a first region and a second region in the lower surface of the inner shroud;

a first impingement unit arranged in the first region and comprising a first impingement plate facing the inner shroud defining a first impingement chamber therebetween, wherein the first impingement plate is configured to receive cooling air and form impingement jet directed to the first impingement chamber;

a second impingement unit arranged in the second region and comprising a second impingement plate facing the inner shroud defining a second impingement chamber therebetween; and at least one connector flow channel configured to direct cooling air from the first impingement chamber to the second region, wherein the second impingement plate is configured to receive cooling air from the at least one connector flow channel and form impingement jet directed to the second impingement chamber, wherein the second impingement unit comprises a cover plate arranged radially inward the second impingement plate and facing the second impingement plate and defining a cooling air receiving chamber therebetween, and wherein an outlet of the at least one connector flow channel is positioned in the cooling air receiving chamber.

10. The turbine vane according to claim 1, wherein the lower surface of the inner shroud in the first region comprises a base opening of an airfoil of the turbine vane, and wherein the first impingement chamber and the base opening of the airfoil are non-overlapping.

11. The turbine vane according to claim 1, wherein a diameter of second impingement holes of the second impingement plate are smaller than a diameter of first impingement holes of the first impingement plate.

12. The turbine vane according to claim 1, wherein the inner shroud comprises at least one shroud cooling hole having an inlet positioned in the second impingement chamber and an outlet positioned in the upper surface of the inner shroud or in a side surface of the inner shroud.

13. A gas turbine comprising:

a compressor configured to compress air introduced thereinto from an outside;

a combustor configured to mix fuel with air compressed by the compressor for combustion; and a turbine including a plurality of turbine vanes and a plurality of turbine blades mounted on blade carrying disks and rotated by combustion gas produced by the combustor, wherein each of the plurality of turbine vanes comprises:

an inner shroud having an upper surface and a lower surface;

a seal unit disposed in the lower surface of the inner shroud and defining a first region and a second region in the lower surface of the inner shroud;

a first impingement unit arranged in the first region and comprising a first impingement plate facing the inner shroud defining a first impingement chamber therebetween, wherein the first impingement plate is configured to receive cooling air and form impingement jet directed to the first impingement chamber;

a second impingement unit arranged in the second region and comprising a second impingement plate facing the inner shroud defining a second impingement chamber therebetween;

at least one connector flow channel configured to direct cooling air from the first impingement chamber to the second region, and an interstage seal axially disposed between the blade carving disk and the turbine vane, wherein the second impingement plate is configured to receive cooling air from the at least one connector flow channel and form impingement jet directed to the second impingement chamber, wherein the second impingement unit is positioned in a space defined by the inner shroud of the turbine vane, the seal unit and the interstage seal, wherein the interstage seal is configured to seal the space at radially inner side of the space.

14. The gas turbine according to claim 13, wherein the inner shroud comprises a first impingement cavity in the lower surface of the inner shroud in the first region, and the first impingement chamber includes the first impingement cavity.

15. The gas turbine according to claim 13, wherein the inner shroud comprises a second impingement cavity in the lower surface of the inner shroud in the second region, and the second impingement chamber includes the second impingement cavity.

16. The gas turbine according to claim 15, wherein the first impingement cavity and the second impingement cavity are separated by an intervening section of the inner shroud, and wherein the at least one connector flow channel extends through the intervening section of the inner shroud.

17. The gas turbine according to claim 16, wherein the second impingement plate is arranged to be flush with an opening of the second impingement cavity, or the second impingement plate is arranged within the second impingement cavity.

18. The gas turbine according to claim 13, wherein the at least one connector flow channel extends through the seal unit.

19. The gas turbine according to claim 13, wherein the first impingement plate is configured to receive cooling air from a last stage of the compressor.

20. The gas turbine according to claim 13, wherein a radial distance of the second impingement plate from the lower surface of the inner shroud is less than a radial distance of the first impingement plate from the lower surface of the inner shroud.

* * * * *